US005092604A

United States Patent [19]

Oka

[11] Patent Number: 5,092,604

[45] Date of Patent: Mar. 3, 1992

[54] GOLF BALL

[75] Inventor: Kengo Oka, Kobe, Japan

[73] Assignee: Sumitomo Rubber Industries, Ltd., Hyogo, Japan

[21] Appl. No.: 540,644

[22] Filed: Jun. 19, 1990

Related U.S. Application Data

[63] Continuation of Ser. No. 307,757, Feb. 6, 1989, abandoned.

[30] Foreign Application Priority Data

Feb. 27, 1988 [JP] Japan ..... 64-46916

[51] Int. Cl.[5] ..... A63B 37/14

[52] U.S. Cl. ..... 273/232

[58] Field of Search ..... 273/232, 233, 213, 62; 40/327

[56] References Cited

U.S. PATENT DOCUMENTS 4,762,326 8/1988 Gobush ..... 273/232

*Primary Examiner*—George J. Marlo

[57] ABSTRACT

The method of making a family of golf balls, each ball having substantially identical carry characteristics in both the pole and seam hitting modes and having between 300 and 600 dimples arranged on the spherical surfaces thereof, comprising the steps:

projecting a cubic octahedron (2) on the spherical surface of a said golf ball to provide four great circle paths (6) thereon defining six spherical squares (5) and eight spherical triangles (4) on the said surface;

placing a plurality of dimples in each said square and triangle without intersecting said dimples and said great circle paths; and selecting the number of dimples in each said square and triangle such that the total number of dimples on said ball is a natural number satisfying one of the following formulae:

$$(4m\times 6)+(3n\times 8)$$

$$((4m+1)\times 6)+(3n\times 8)$$

$$(4m\times 6)+((3n+1)\times 8$$

$$((4m+1)\times 6)+((3n+1)\times 8)$$

where m is a natural number representative of the number of dimples within one spherical square and n is a natural number representative of the number of dimples within one spherical triangle.

19 Claims, 20 Drawing Sheets

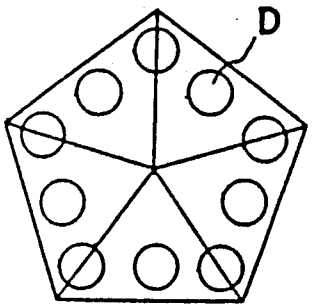
Fig. 10(I)
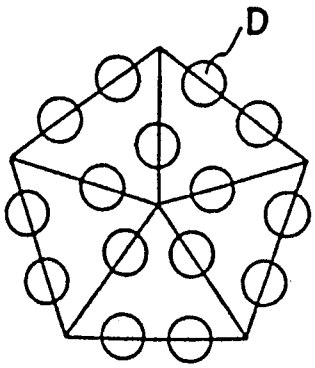
Fig. 10(II)
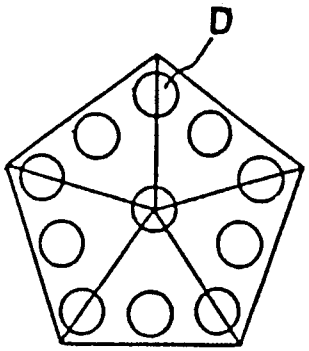
Fig. 10(III)
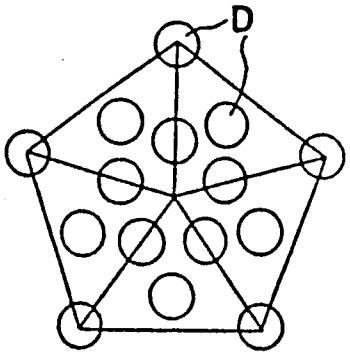
Fig. 10(IV)
Fig. 11(I)
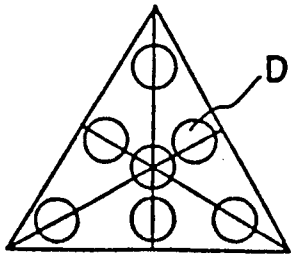
Fig. 11(II)
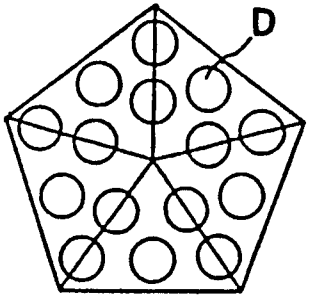
Fig. 11(III)
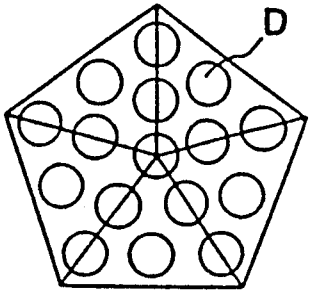
Fig. 11(IV)

GOLF BALL

This application is a continuation of Ser. No. 07/307,757, filed Feb. 6, 1989, now abandoned.

BACKGROUND OF THE INVENTION the present invention generally relates to a golf ball, and more particularly, to a golf ball with improved dimples, in which a range of the total number of dimples which may be designed is broadened to provide the golf ball having the total number of dimples suitable for each user.

Conventionally, with respect to the arrangement of dimples to be provided on the surface of a gold ball, various techniques have been proposed for the purpose of mainly improving flight performance of the gold ball, and presently, the five following arrangements are chiefly put into actual application.

(1) Regular icosahedron arrangement (British Patent No. 1475413)

(2) Regular dodecahedron arrangement (U.S. Pat. No. 4,142,727)

(3) Icosahedron-dodecahedron arrangement (U.S. Pat. No. 4,560,168)

(4) Regular octahedron arrangement (U.S. Pat. No. 4,720,111)

(5) Concentric arrangement (Japanese Laid-open Patent Application Tokkaisho No. 53-115330)

Generally, in the arrangement of dimples for a golf ball, it is not preferable to adopt an arrangement with such a sharp directivity as will give rise to differences in trajectory due to a difference in a rotary axis of back spinning upon shooting the golf ball. Of the five arrangements referred to above, the regular icosahedron arrangement in item (1) and the concentric arrangement in item (5) are poor in the spherical symmetrical characteristic due to dimples arrangements thereof, with a consequently sharp directivity, and thus, cannot be considered as preferable, without meeting the requirement for non-directivity.

Meanwhile, the total number of dimples to be provided on a golf ball is generally in the range of 300 to 600 pieces, and owing to the reason as described hereinafter, it is preferable to provide as many kinds of dimple total numbers for the designing as possible, within the above range and under the limitation effective from the viewpoint of the spherical symmetrical characteristic referred to earlier.

More specifically, as one of the aerodynamic effects of dimples, improvement of lift may be raised. While flying as it is back spinning, a golf ball displaces a separating point of an air stream above the golf ball more rearwardly than that below said golf ball, and thus, pressure of air at the upper portion of the ball is reduced to a larger extent than that at the lower portion thereof, thereby to raise the ball higher, and such a lift may be increased by providing dimples on the surface of the golf ball in a proper number.

Within the range of the dimple total number of 300 to 600 pieces generally adopted for the golf ball as described above, the effect for the improvement of lift is increased with the decrease of the number of dimples so as to provide a golf ball for a high trajectory, while the effect for the lift improvement is reduced as the number of dimples is increased to provide a golf ball for a low trajectory as is known to those skilled in the art.

Accordingly, a golf player who will find it difficult to apply proper back spinning and to raise the golf ball high should preferably use a golf ball for the high trajectory with a small number of dimples, while on the contrary, a player who will lose a sufficient carry or be readily affected by wind, should desirably employ a golf ball for a low trajectory with many dimples.

In recent years when age, physical strength, ability, etc. of golf players are diversified due to increase of the golf playing population, it becomes desirable to provide dimple arrangements capable of designing the dimple total number in many kinds within the range of dimple total number of 300 to 600 pieces in order to prepare golf balls suitable for the respective golf players.

Upon review on the points as to whether or not the kinds of the dimple total number which can be designed are sufficiently many for the purpose, the dimple arrangements conventionally proposed as described earlier have various problems. More specifically, although the dodecahedron arrangement in item (2), icosahedron-dodecahedron arrangement in item (3) and regular octahedron arrangement in item (4) referred to earlier have no particular problems with respect to the symmetrical characteristic, there are such disadvantages that they are not sufficient in the freedom for the designing of the dimple total number, with the dimple total number which can be designed being undesirably limited, thus being unable to fully cope with the requirements in the field of this market as stated previously.

(a) Regular Dodecahedron Arrangement

In the first place, in the regular dodecahedron arrangement, dimples are uniformly arranged in the twelve spherical regular pentagons, and the dimple total number will become a multiple of twelve. Therefore, even when one of the spherical regular pentagons is considered, the dimples therein are required to be arranged in a good symmetrical characteristic as far as practicable. Accordingly, as shown in FIG. 10(I), if the dimples are arranged so that none of the dimples D intersect sides of the spherical regular pentagon, the dimple number is represented by 5n where n is a natural number). Meanwhile, when the dimples are arranged so that centers of the dimples D are aligned with corresponding sides of the pentagon as illustrated in FIG. 10(II), it may be regarded that one spherical regular pentagon possesses ½ piece of each dimple, since two spherical regular pentagons commonly possess one dimple in this case. Also, since the dimples on one side of the pentagon are in even number without fail for the convenience in the preparation of the parting line for a split metallic mold, the number of dimples within one spherical pentagon still becomes 5n (where n is a natural number). As shown in FIG. 10(III), in the case where one dimple is disposed at the center of the spherical pentagon, the dimple number will be represented by $5n+1$ where n is a natural number). On the other hand, as shown in FIG. 10(IV), when the dimples are arranged at five apexes of the spherical pentagon, the dimple number will be represented by $5n+5/3$ (where n is a natural number). Further, in the case where the dimples are arranged at the center and five apexes of the spherical pentagon as in a combination of FIGS. 10(III) and 10(IV), the dimple number will be $5n+1+5/3$.

As described so far, in the regular dodecahedron arrangement, the dimple total number which can be designed will be as follows, $5n \times 12$ $(5n+1) \times 12$ $(5n+5/3) \times 12$ $(5n+1+5/3) \times 12$ (where n is a natural number).

As described earlier, the total number of dimples to be used for golf balls is within the range of 300 to 600 pieces, and the number of dimples which can be designed by the above four equations within said range will be extremely limited to 21 kinds as shown in Table 1 below.

TABLE 1

| $5n \times 12$ | $(5n + 1) \times 12$ | $(5n + 5/3) \times 12$ | $(5n + 1 + 5/3) \times 12$ |
|---|---|---|---|
| 300 | 312 | 320 | 332 |
| 360 | 372 | 380 | 392 |
| 420 | 432 | 440 | 452 |
| 480 | 492 | 500 | 512 |
| 540 | 552 | 560 | 572 |
| 600 | | | |

As is seen from the above Table 1, for example, the dimple total number which can be designed and which is larger than 332 pieces is not present up to 360 pieces, and that larger than 392 pieces is not present up to 420 pieces.

(b) Icosahedron-Dodecahedron Arrangement

In the icosahedron-dodecahedron arrangement, dimples are uniformly arranged in both of twenty spherical regular triangles and twelve spherical regular pentagons respectively. Upon connection of sides of the spherical regular triangles and spherical regular pentagons, six great circles are formed, and since one of the great circles is overlapped with a parting line of a split metallic mold, dimples cannot be arranged on the great circle. Even when only one of the spherical triangles is taken up for consideration, the dimples to be disposed therein should be arranged to provide a good symmetrical characteristic as far as possible, and no dimples can be arranged on the sides of the spherical triangle. Therefore, the number of dimples within one spherical triangle will be represented as 3m (m is a natural number) as shown in FIG. 11(I) or as $3m+1$ (m is a natural number) when one dimple D is arranged at the center of the spherical triangle as shown in FIG. 11(II). Similarly, upon consideration of one spherical pentagon, the dimple to be disposed therein should be arranged in a good symmetrical characteristic, and since the dimple cannot be arranged on the sides of the spherical pentagon, the number of dimples within one spherical pentagon will be represented by 5n (n is a natural number) as shown in FIG. 11(III) or by $5n+1$ (n is a natural number) when one dimple D is disposed at the center of the spherical pentagon as illustrated in FIG. 11(IV).

In other words, in the case of the icosahedron-dodecahedron arrangement, the number of dimples which can be designed will be as follows, $3m \times 20 + 5n \times 12$ $3m \times 20 + (5n+1) \times 12$ $(3m+1) \times 20 + 5n \times 12$ $(3m+1) \times 20 + (5n+1) \times 12$ (each of m and n is a natural number).

The total number of dimples which corresponds to the above four equations and can be designed in the icosahedron-dodecahedron arrangement in the range of 300 to 600 pieces referred to earlier is as shown in Table 2 below.

TABLE 2

| $3m \times 20 + 5n \times 12$ | $3m \times 20 + (5n + 1) \times 12$ | $(3m + 1) \times 20 + 5n \times 12$ | $(3m + 1) \times 20 + (5n + 1) \times 12$ |
|---|---|---|---|
| 300 | 312 | 320 | 332 |
| 360 | 372 | 380 | 392 |
| 420 | 432 | 440 | 452 |
| 480 | 492 | 500 | 512 |
| 540 | 552 | 560 | 572 |
| 600 | | | |

As is seen from the above Table 2, the dimple number is very limited to 21 kinds in this case also.

(c) Regular Octahedron Arrangement

In the case of the regular octahedron arrangement, as stated in U.S. Pat. No. 4,720,111 and Japanese Patent Laid-Open Publication Tokkaisho No. 61-22871, the total number of dimples which can be designed within the range of 300 to 600 pieces is limited only to four kinds of 336, 416, 504 and 528 pieces.

SUMMARY OF THE INVENTION

Accordingly, an essential object of the present invention is to provide an improved golf ball which is superior in spherical face symmetrical characteristic from the viewpoint of dimple arrangement so as to suit the requirement for non-directivity, and which can be designed to have various total numbers of dimples within the set total number of dimples in the range of 300 to 600 pieces, thereby to cope with the demand of a diversifying market in this field.

Another object of the present invention is to provide a golf ball of the above described type which is simple in construction, and can be readily manufactured on a large scale at low cost.

In accomplishing these and other objects, according to one preferred embodiment of the present invention, there is provided a golf ball which includes a spherical surface circumscribing a cubic octahedron, eight spherical triangles and six spherical squares divided by imaginary lines obtained by projecting edge lines of said cubic octahedron onto said spherical surface, and dimples arranged within said spherical triangles and said spherical squares approximately equally and in point or line symmetry without intersecting said imaginary lines. The total number of the dimples arranged on the entire spherical surface of said golf ball is set in a range of 300 to 600 pieces, and one zone of four great circle zones obtained by connecting said imaginary lines is adapted to coincide with a parting line of a split metallic mold.

By the arrangement of the present invention as described above, it is made possible to remarkably increase the dimple total number which can be designed within the range of 300 to 600 pieces, i.e., up to two times of that in the conventional regular dodecahedron arrangement by employing the cubic octahedron arrangement, thereby to cope with the requirement in the diversifying market. Furthermore, the cubic octahedron arrangement according to the present invention is superior in the symmetrical characteristic and non-directivity.

BRIEF DESCRIPTION OF THE DRAWINGS

These and other objects and features of the present invention will become clear from the following description taken in conjunction with the preferred embodiments thereof with reference to the accompanying drawings, in which:

FIGS. 10(I), 10(II), 10(III), and 10(IV) are diagrams showing examples of dimple dispositions each in one spherical pentagon in the regular dodecahedron arrangement;

FIGS. 11(I) and 11(II) are diagrams showing examples of dimple dispositions each in one spherical regular triangle in the icosahedron-dodecahedron arrangement;

FIGS. 11(III) and 11(IV) are diagrams showing examples of dimple dispositions each in one spherical pentagon in the icosahedron-dodecahedron arrangement;

DETAILED DESCRIPTION OF THE INVENTION

Figure 1I:
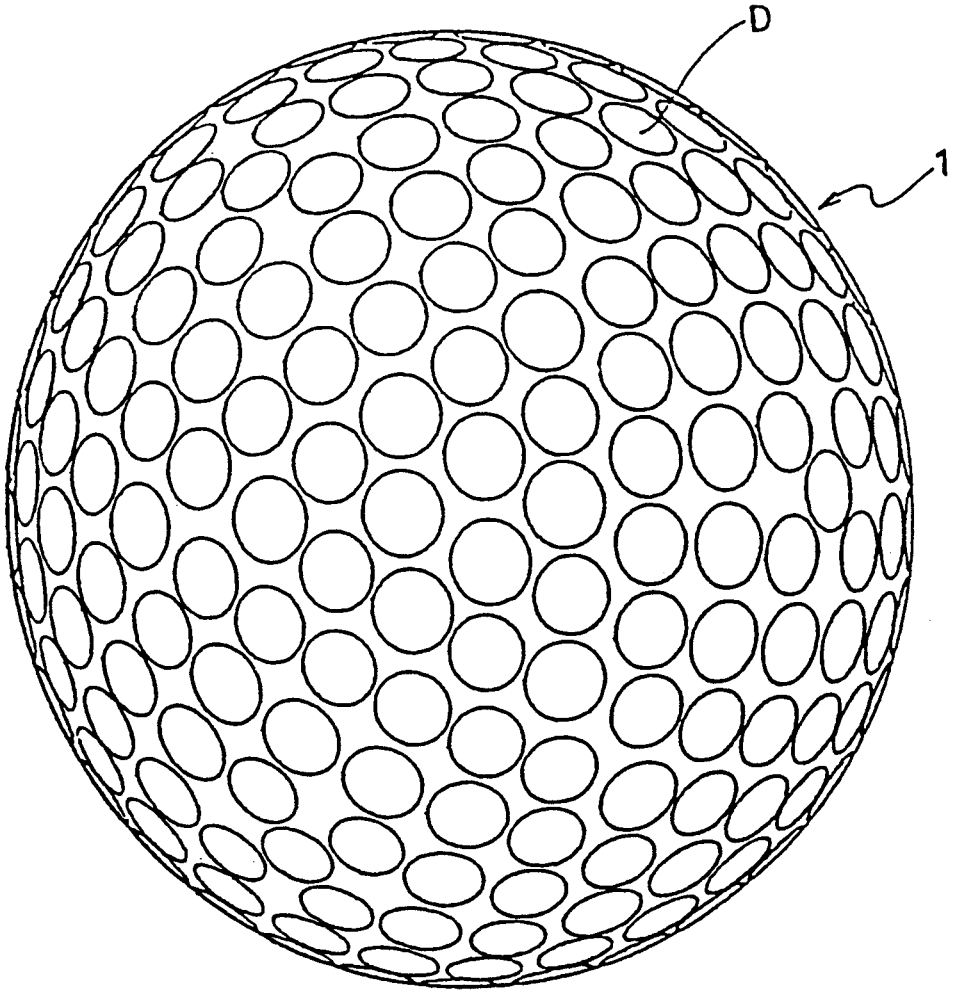
FIG. 1(I) is a front elevational view of a golf ball according to a first embodiment of the present invention.

Before the description of the present invention proceeds, it is to be noted that like parts are designated by like reference numerals throughout the accompanying drawings.

Figure 1:
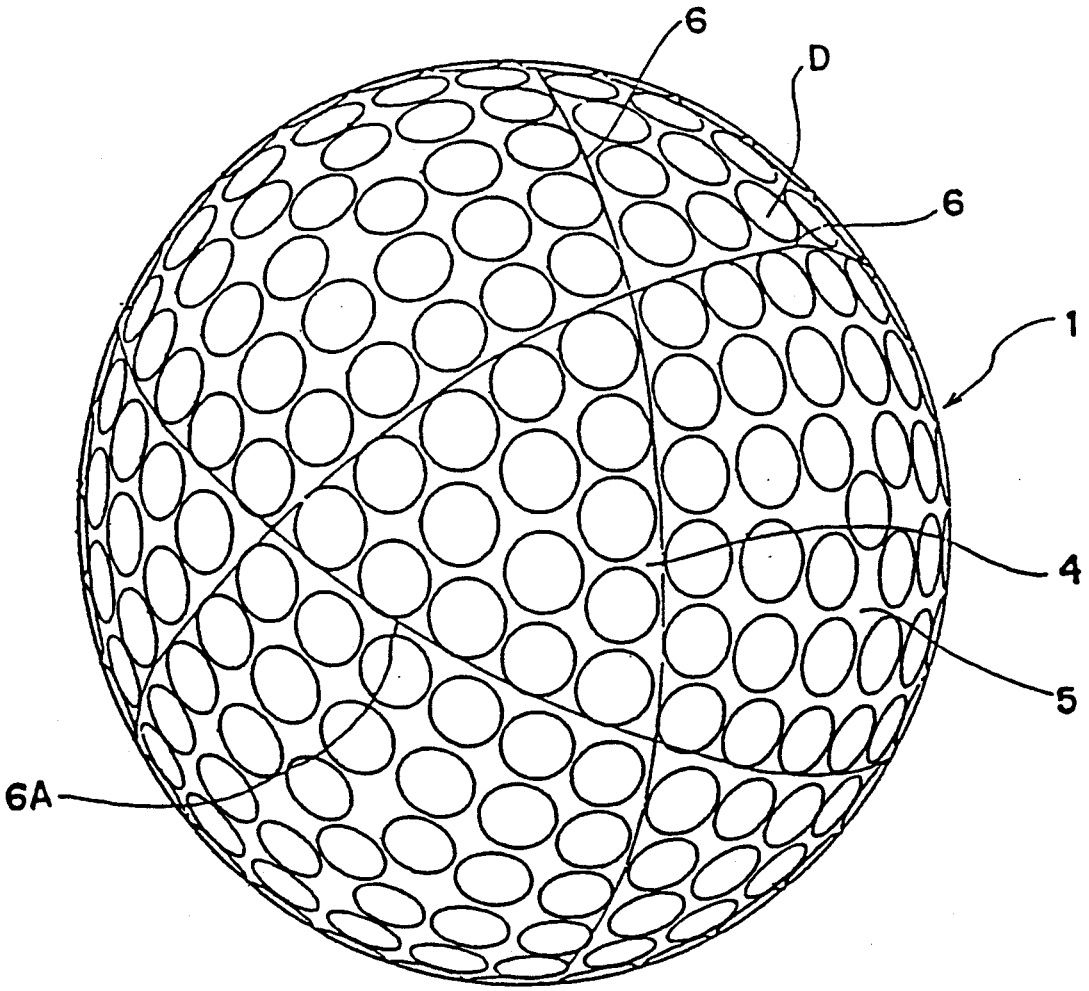
FIG. 1(II) is a view similar to FIG. 4(I), which particularly shows the golf ball as divided into a cubic octahedron pattern.

Referring now to the drawings, there is shown in FIG. 1(I) a golf ball 1 according to a first embodiment of the present invention, in which dimples D formed on the surface of said golf ball 1 are arranged in the form of a cubic octahedron, while FIG. 1(II) represents the state where the golf ball 1 is divided into the cubic octahedron on its surface.

Figure 2:
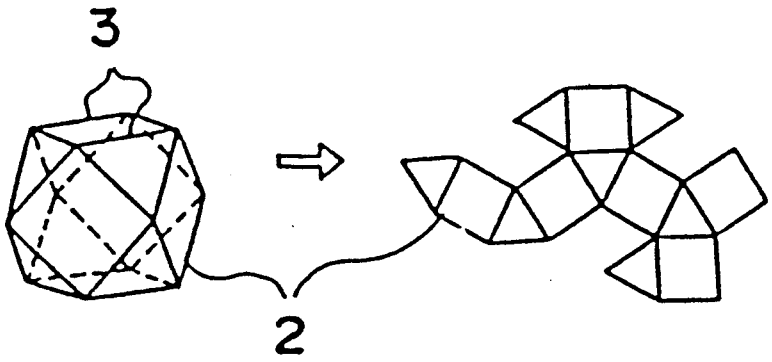
FIG. 2 shows a cubic octahedron and its development.

In the cubic octahedron arrangement as referred to above, the spherical surface of the golf ball 1 is sectioned into eight spherical triangles 4 and six spherical squares 5 (FIG. 1(II)) by imaginary lines to be obtained by projecting edge lines 3 of a cubic octahedron 2 onto a circumscribing sphere as shown in FIG. 2, and the dimples D are arranged in the respective spherical triangles 4 and spherical squares 5 approximately equally and in a point or line symmetrical relation. Since the dimples D are not arranged on the imaginary lines, great circles of the circumscribing sphere are formed by connecting the imaginary lines. In other words, the golf ball 1 of the cubic octahedron arrangement is to be provided with great circle zones 6 not intersecting the dimples D, and the number of such great circle zones is four zones. One great circle zone 6A (FIG. 1(II)) of said great circle zones 6 is adapted to coincide with a parting line of a split metallic mold (not shown) to be used for the manufacture of said golf ball.

Since the golf ball as described above is molded by the split metallic mold composed of semi-spherical upper mold and lower mold, burr is formed on the parting line between the upper and lower molds during the molding. Although such burr is scraped off in a later processing by buffing, the great circle zone 6A on the parting line is inevitably increased in its width as compared with the other great circle zones 6. Therefore, the width of the great circle zone 6A on said parting line is preliminarily reduced to be narrower than that of the other great circle zones 6 so as to be of the same width as that of the other circle zones 6 after buffing of the burr, so that such great circle zone 6A on the parting line is not conspicuous in appearance.

The number of dimples in the respective spherical triangles and spherical squares and the total number of dimples which can be designed in said cubic octahedron arrangement are as described hereinafter.

Figure 3I:
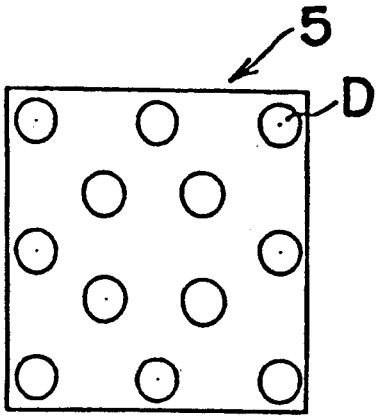
FIGS. 3(I) and 3(II) show examples, in each of which dimples are arranged in one spherical square of the cubic octahedron arrangement.
Figure 3:
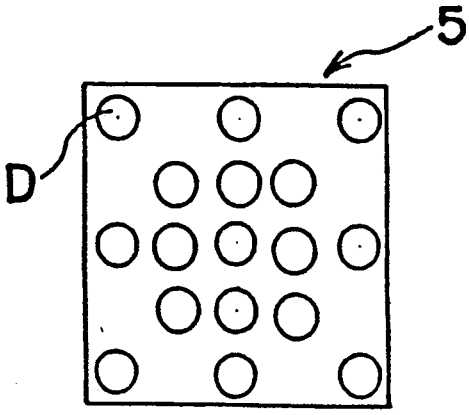

When one of the spherical squares is taken up for consideration, the dimples D to be disposed therein should be arranged to provide a good symmetrical characteristic as far as possible, and no dimples can be arranged on the sides of the spherical square. Therefore, the number of dimples within one spherical square will be represented as 4m (m is a natural number) as shown in FIG. 3(I) or as 4m+1 (m is a natural number) when one dimple D is arranged at the center of the spherical square as shown in FIG. 3(II).

In the case of the spherical triangle, the number of dimples to be arranged therein becomes 3n (n is a natural number) or 3n+1 in the similar manner as in the case of the spherical triangle of the icosahedron-dodecahedron arrangement referred to earlier with reference to FIGS. 11(I) and 11(II).

More specifically, in the case of the cubic octahedron arrangement, the number of dimples which can be designed will be, $$4m\times 6+3n\times 8$$

$$(4m+1)\times 6+3n\times 8$$

$$4m\times 6+(3n+1)\times 8$$

$$(4m+1)\times 6+(3n+1)\times 8$$

(each of m and n is a natural number).

In Table 3 below, the total number of dimples, which can be designed in the above cubic octahedron arrangement is shown in the range of 300 to 600 pieces.

TABLE 3

| 4m × 6 + 3n × 8 | (4m + 1) × 6 + 3n × 8 | 4m × 6 + (3n + 1) × 8 | (4m + 1) × 6 + (3n + 1) × 8 |
|---|---|---|---|
| 312 | 318 | 320 | 302 |
| 336 | 342 | 344 | 326 |
| 360 | 366 | 368 | 350 |
| 384 | 390 | 392 | 374 |
| 408 | 414 | 416 | 398 |
| 432 | 438 | 440 | 422 |
| 456 | 462 | 464 | 446 |
| 480 | 486 | 488 | 470 |
| 504 | 510 | 512 | 494 |
| 528 | 534 | 536 | 518 |
| 552 | 558 | 560 | 542 |
| 576 | 582 | 584 | 566 |
| 600 | | | 590 |

As is seen from the above Table 3, the total number of dimples which can be designed will be of 50 kinds, which is very large and more than two times that of 21 kinds for the regular dodecahedron (Table 1) and icosahedron-dodecahedron (Table 2) arrangement shown in Table 1.

It is to be noted here that the diameter of the dimples D is arbitrary, and a plurality of kinds of dimples different in diameters may be employed, in which case it is most effective to employ dimples having two or three kinds of different diameters.

Four kinds of golf balls in the cubic octahedron arrangement according to the present invention (embodiments 1, 2, 3 and 4) and five kinds of golf balls having dimple arrangements described earlier as the prior art (comparative examples 1, 2, 3, 4 and 5) were prepared and subjected to the test for carry and test for symmetrical characteristic for comparison between the embodiments and comparative examples.

The golf ball of embodiment 1 is that described earlier with reference to FIGS.(I) and 1(II), with the total number of dimples of 342 pieces.

Figure 4I:
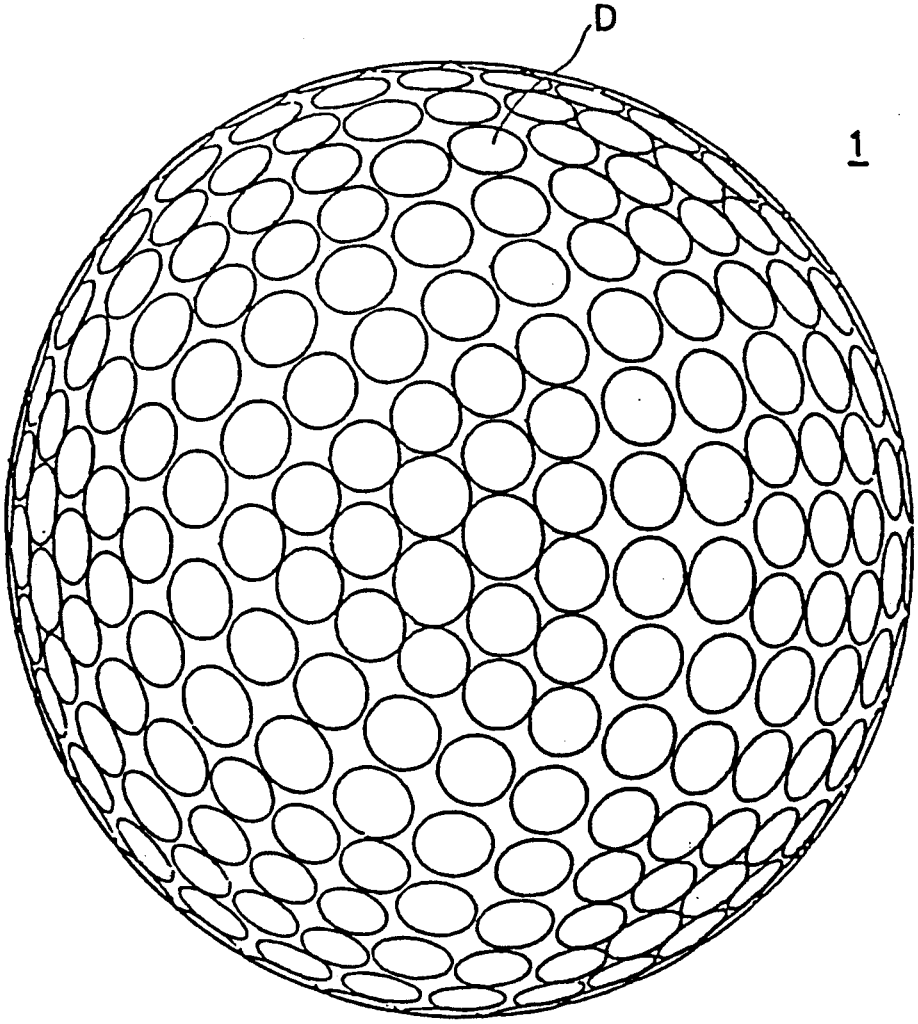
FIG. 4(I) is a front elevational view of a golf ball according to a second embodiment of the present invention.
Figure 4:
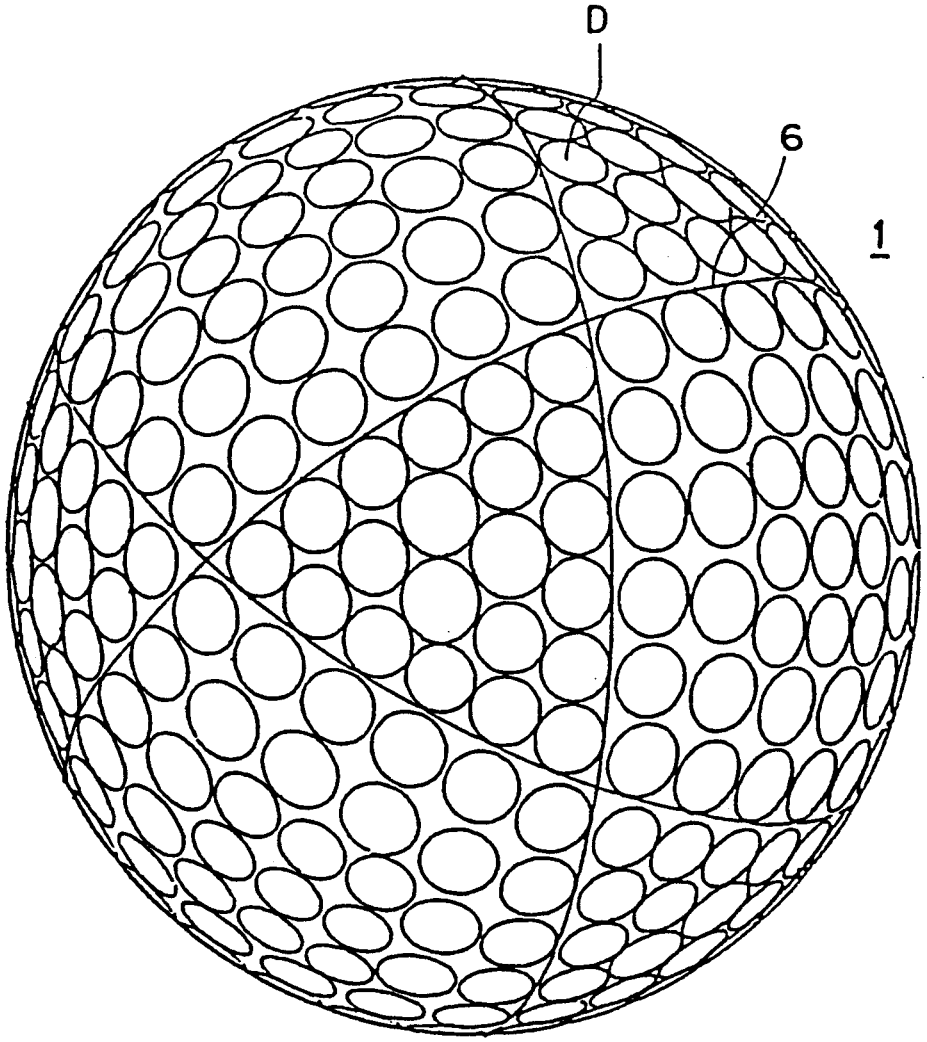
FIG. 4(II) is a view similar to FIG. 4(I), which particularly shows the golf ball as divided into a cubic octahedron pattern.

The golf ball of embodiment 2 is that shown in FIGS. 4(I) and 4(II), with the total number of dimples of 414 pieces.

Figure 12I:
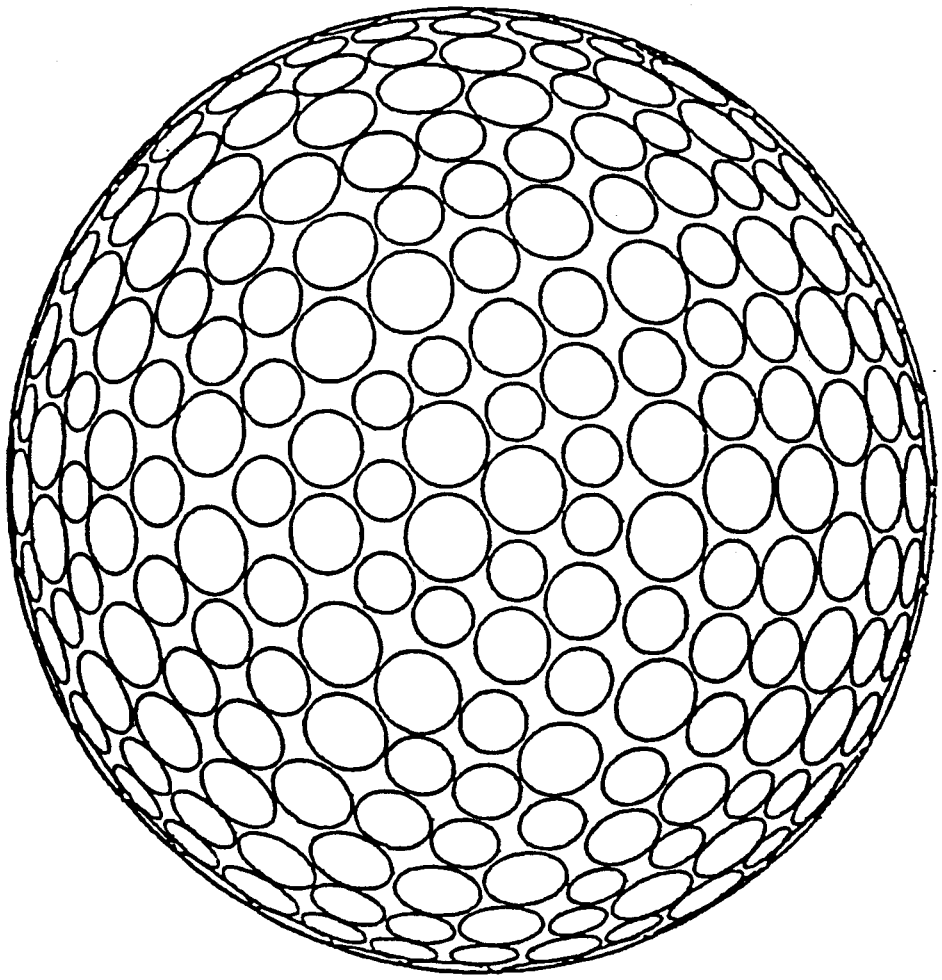
FIG. 12(I) is a front elevational view of a golf ball according to a third embodiment of the present invention.
Figure 12:
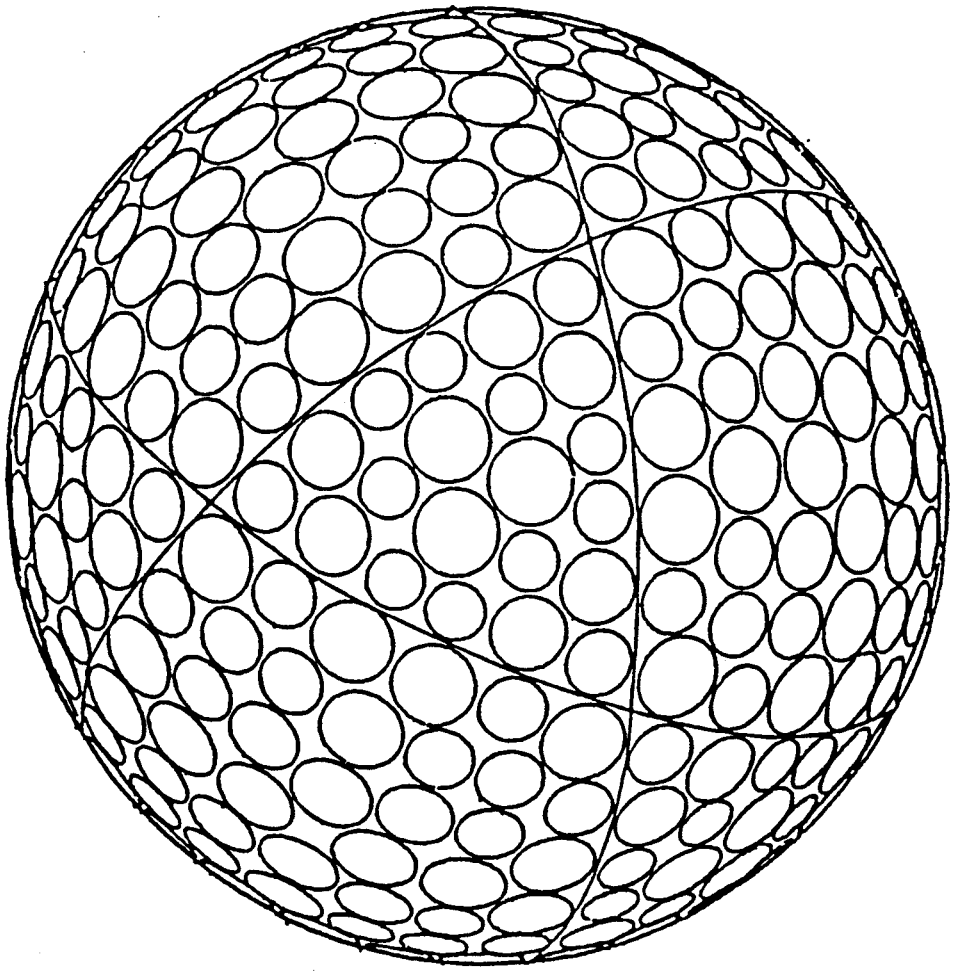
FIG. 12(II) is a view similar to FIG. 12(I), which particularly shows the golf ball as divided into a cubic octahedron pattern.

The golf ball of embodiment 3 is that shown in FIGS. 12(I) and 12(II), with the total number of dimples of 432 pieces.

Figure 13I:
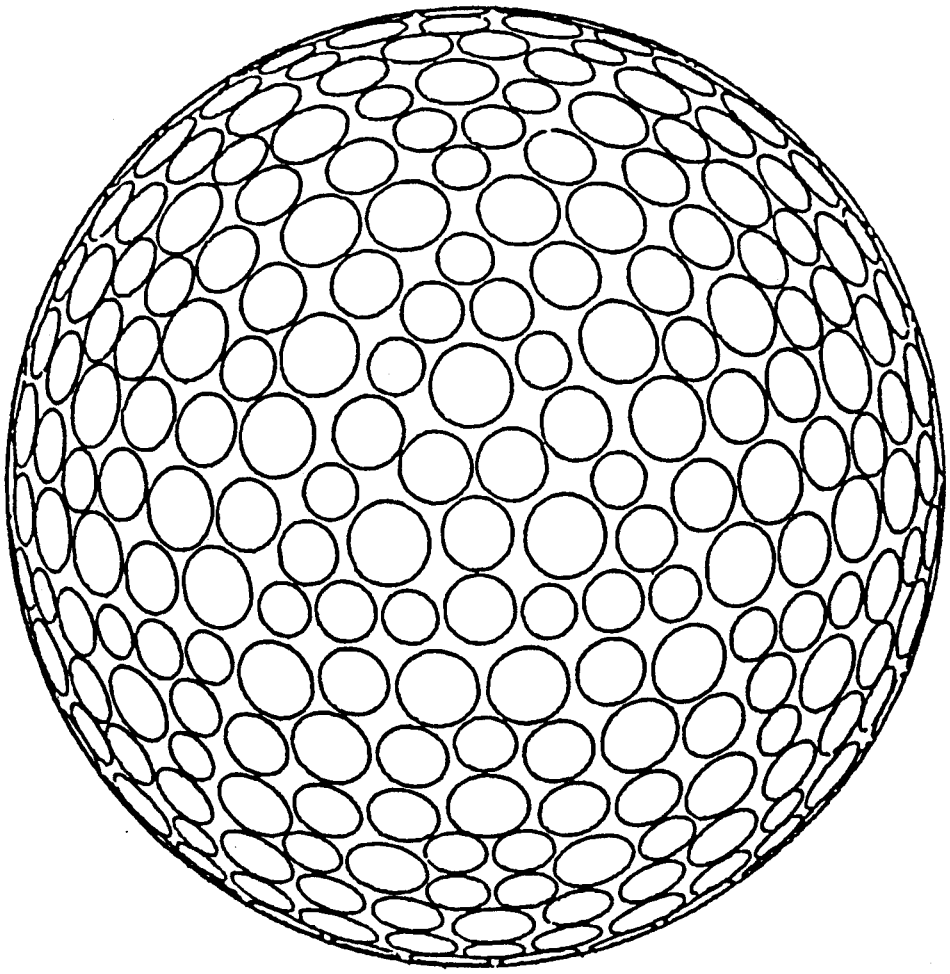
FIG. 13(I) is a front elevational view of a golf ball according to a fourth embodiment of the present invention.
Figure 13:
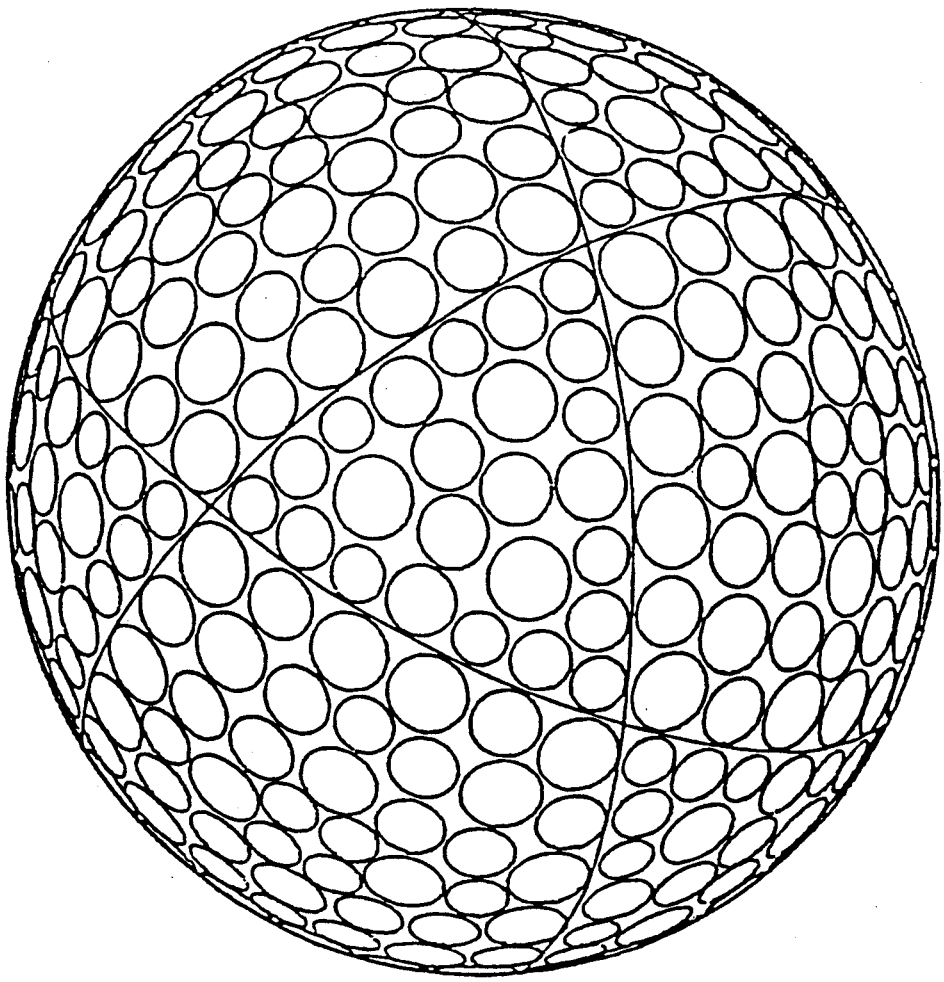
FIG. 13(II) is a view similar to FIG. 13(I), which particularly shows the golf ball as divided into a cubic octahedron pattern.

The golf ball of embodiment 4 is that shown in FIGS. 13(I) and 13(II), with the total number of dimples of 480 pieces.

In the above embodiments 1, 2, 3 and 4, the total sum of the individual dimple volume should preferably be in the range of 250 to 400 $mm^3$, and more particularly, be in the range of 280 to 350 $mm^3$.

Figure 5I:
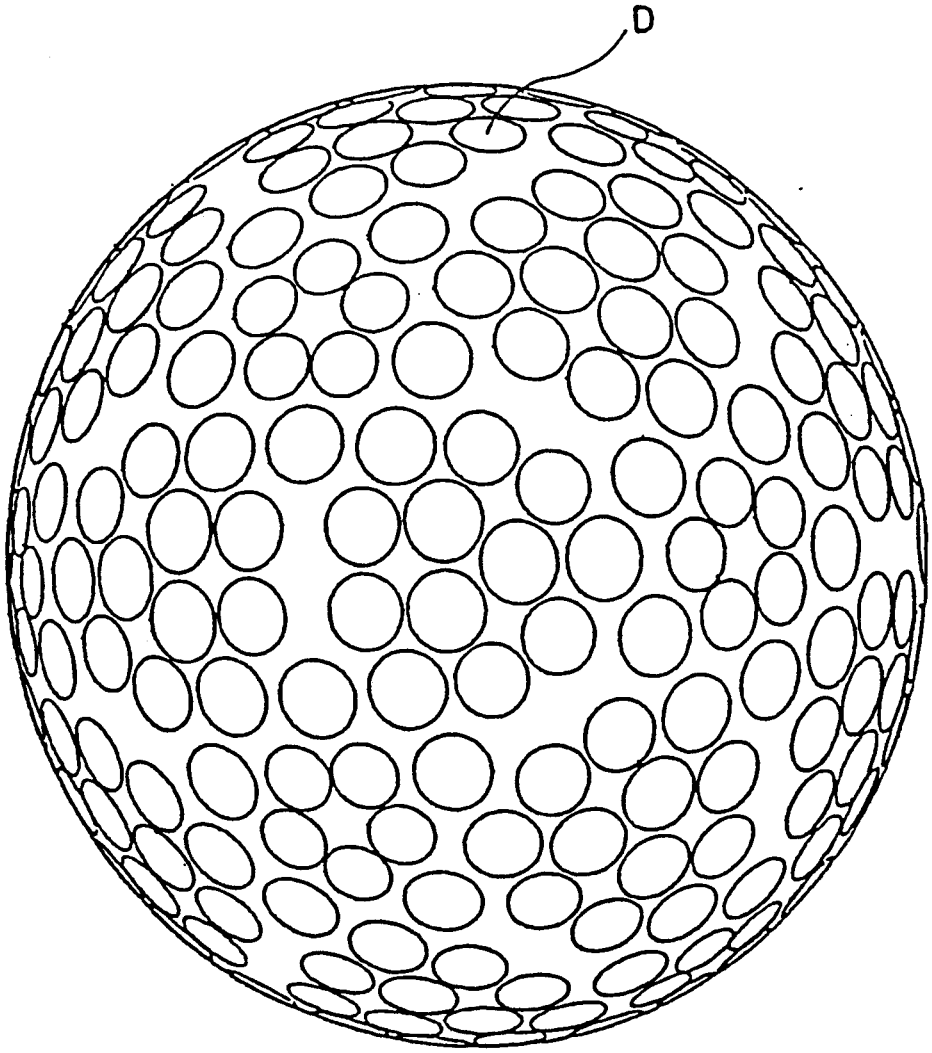
FIG. 5(I) is a front elevational view of a golf ball according to a first comparative example.
Figure 5:
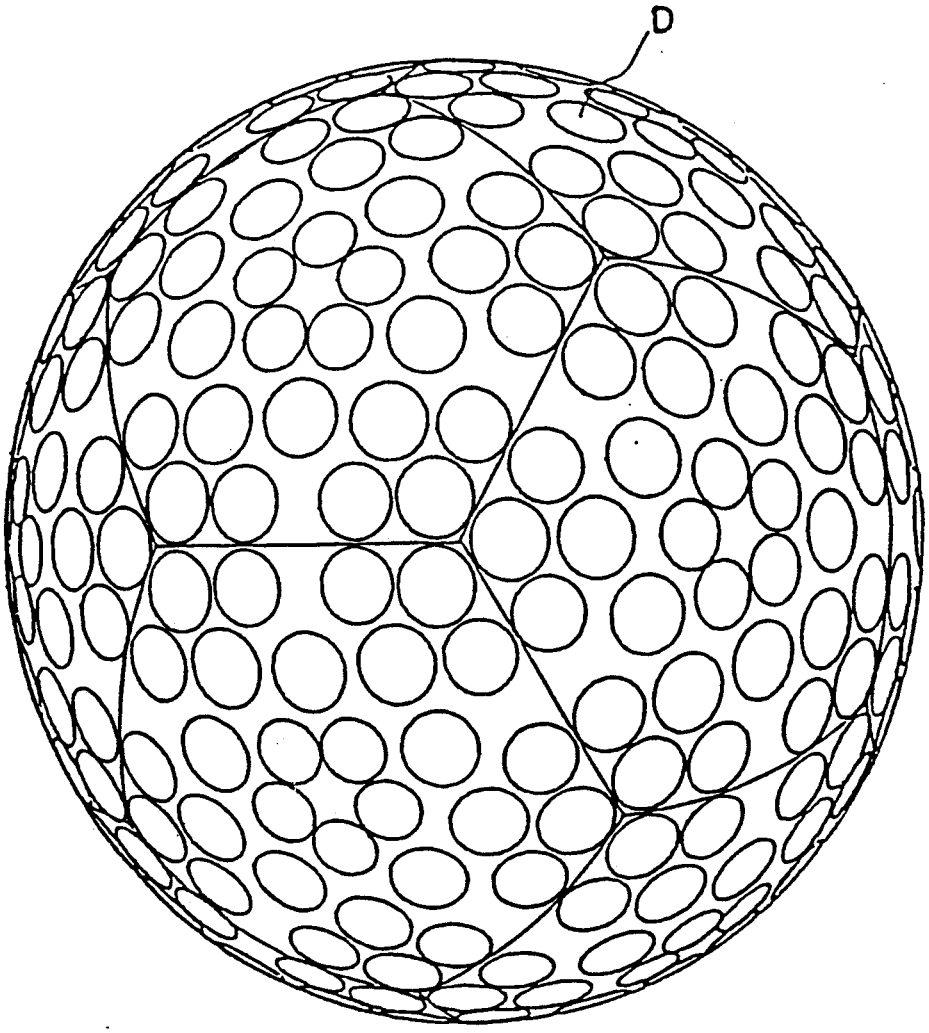
FIG. 5(II) is a view similar to FIG. 5(I), which particularly shows the golf ball as divided into a regular dodecahedron pattern.

The golf ball of comparative example 1 is of the regular dodecahedron arrangement as shown in FIGS. 5(I) and 5(II), with the total number of dimples of 360 pieces.

Figure 6I:
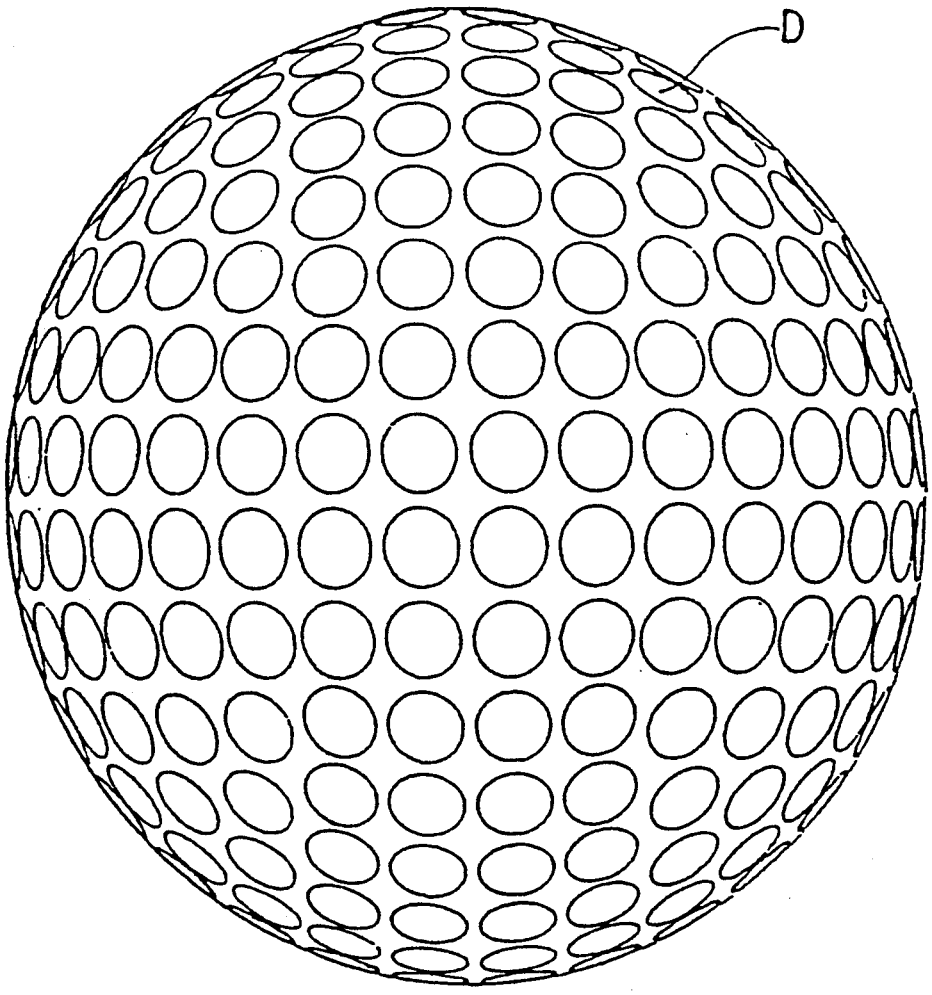
FIG. 6(I) is a front elevational view of a golf ball according to a second comparative example.
Figure 6:
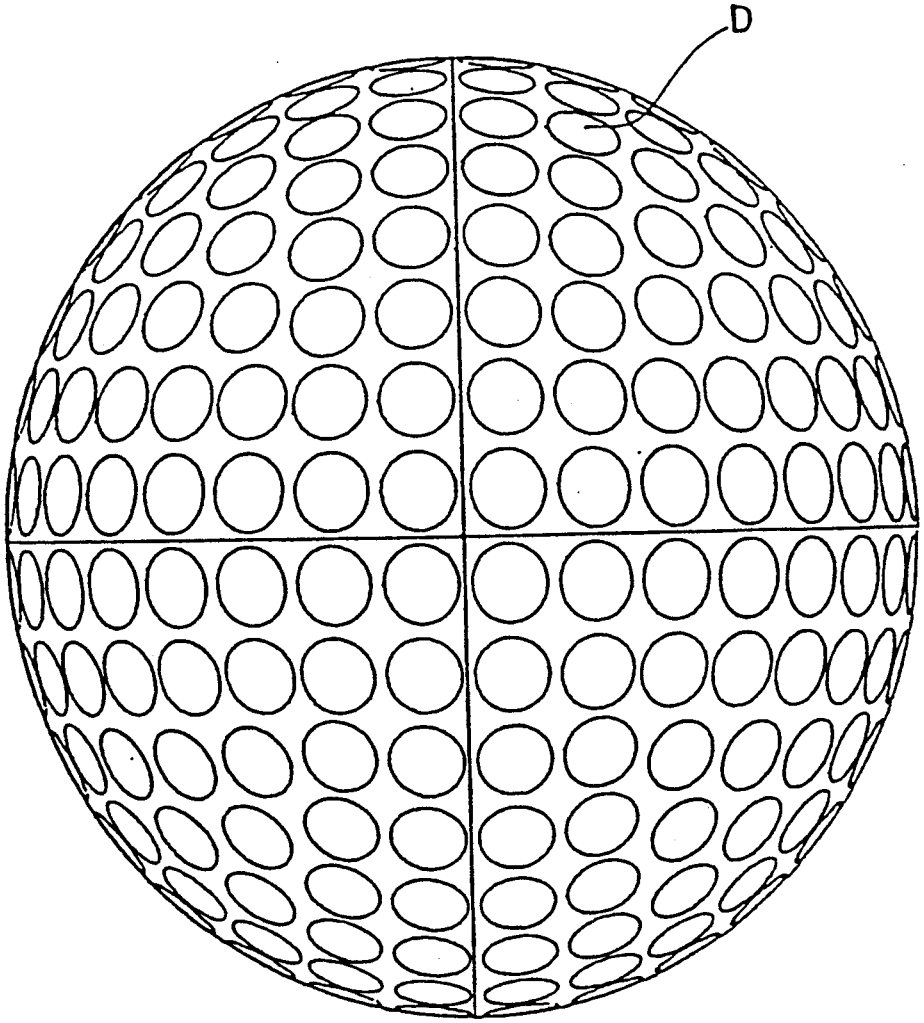
FIG. 6(II) is a view similar to FIG. 6(I), which particularly shows the golf ball as divided into a regular octahedron pattern.

The golf ball of comparative example 2 is of the regular octahedron arrangement as shown in FIGS. 6(I) and 6(II), with the total number of dimples of 336 pieces.

Figure 7I:
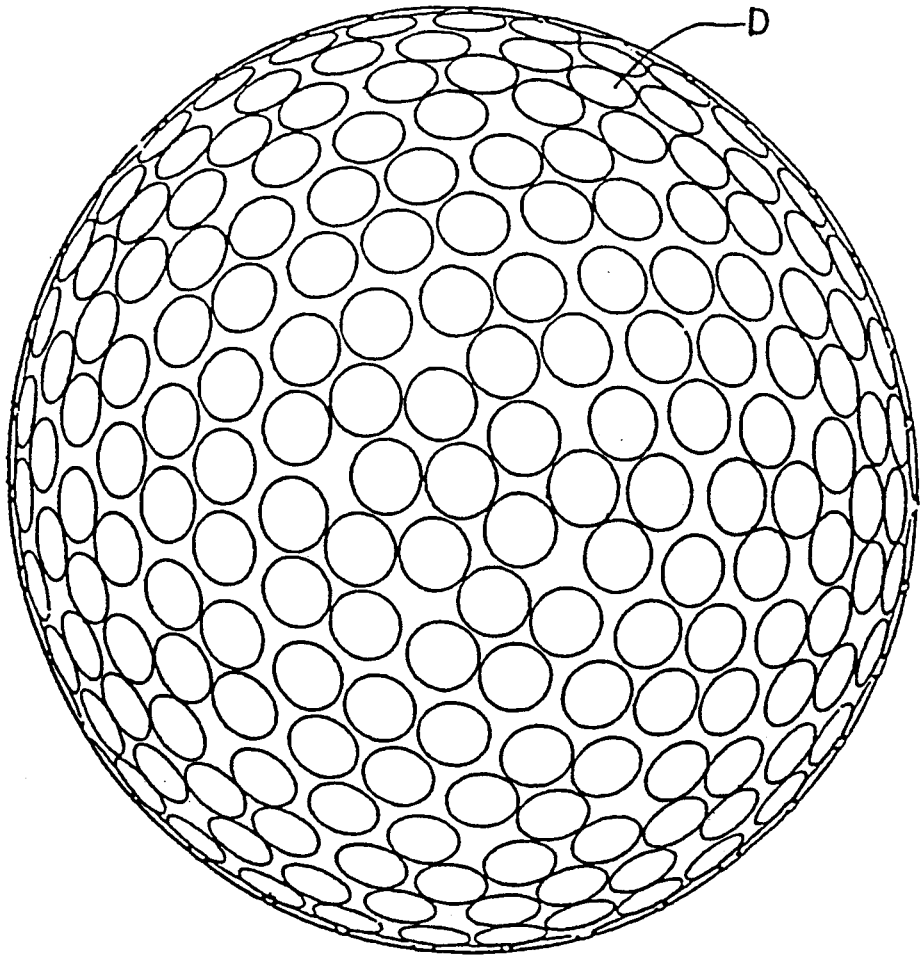
FIG. 7(I) is a front elevational view of a golf ball according to a third comparative example.
Figure 7:
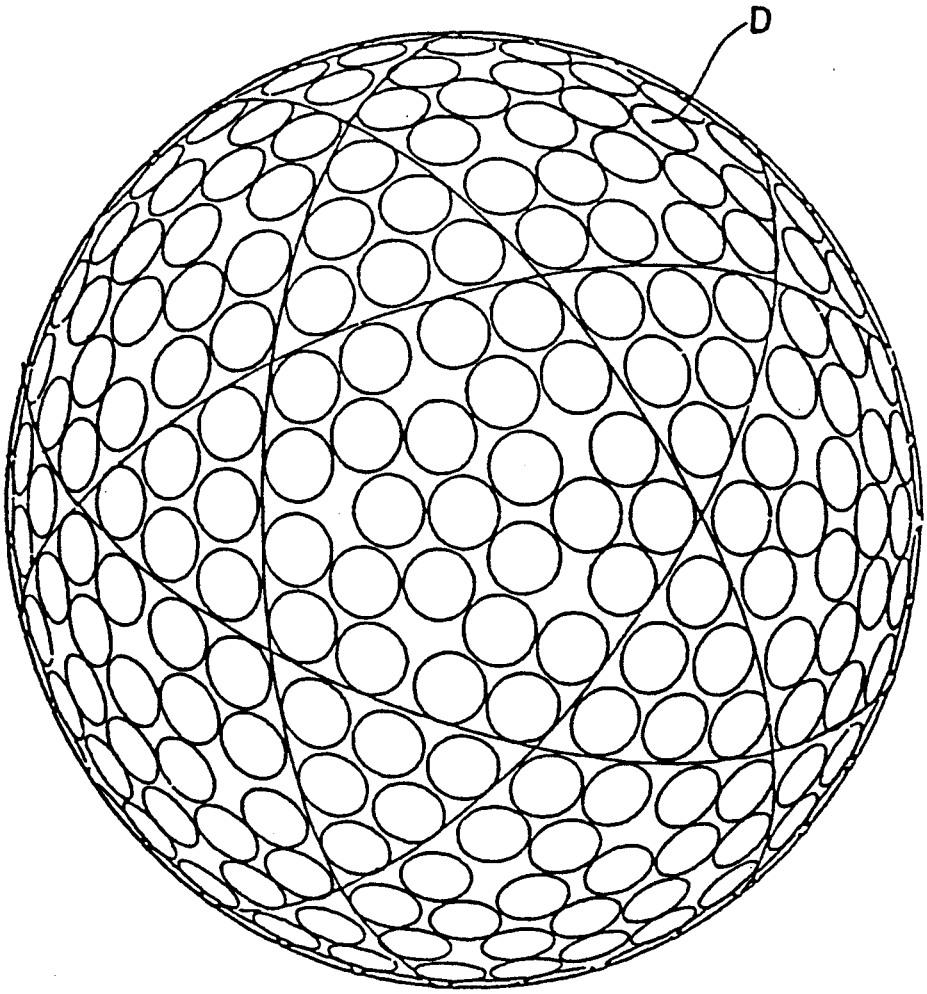
FIG. 7(II) is a view similar to FIG. 7(I), which particularly shows the golf ball as divided into an icosahedron-dodecahedron pattern.

The golf ball of comparative example 3 is of the icosahedron-dodecahedron arrangement as shown in FIGS. 7(I) and 7(II), with the total number of dimples of 432 pieces.

Figure 8I:
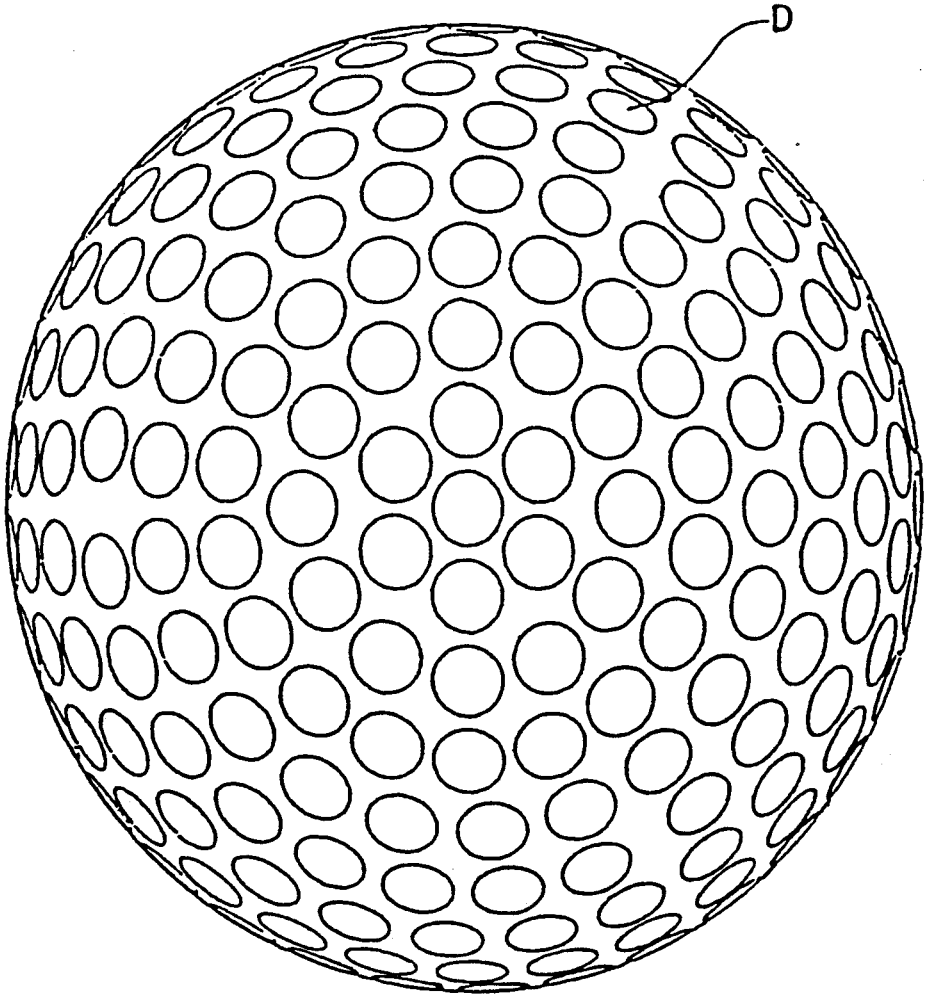
FIG. 8(I) is a front elevational view of a golf ball according to a fourth comparative example.
Figure 8:
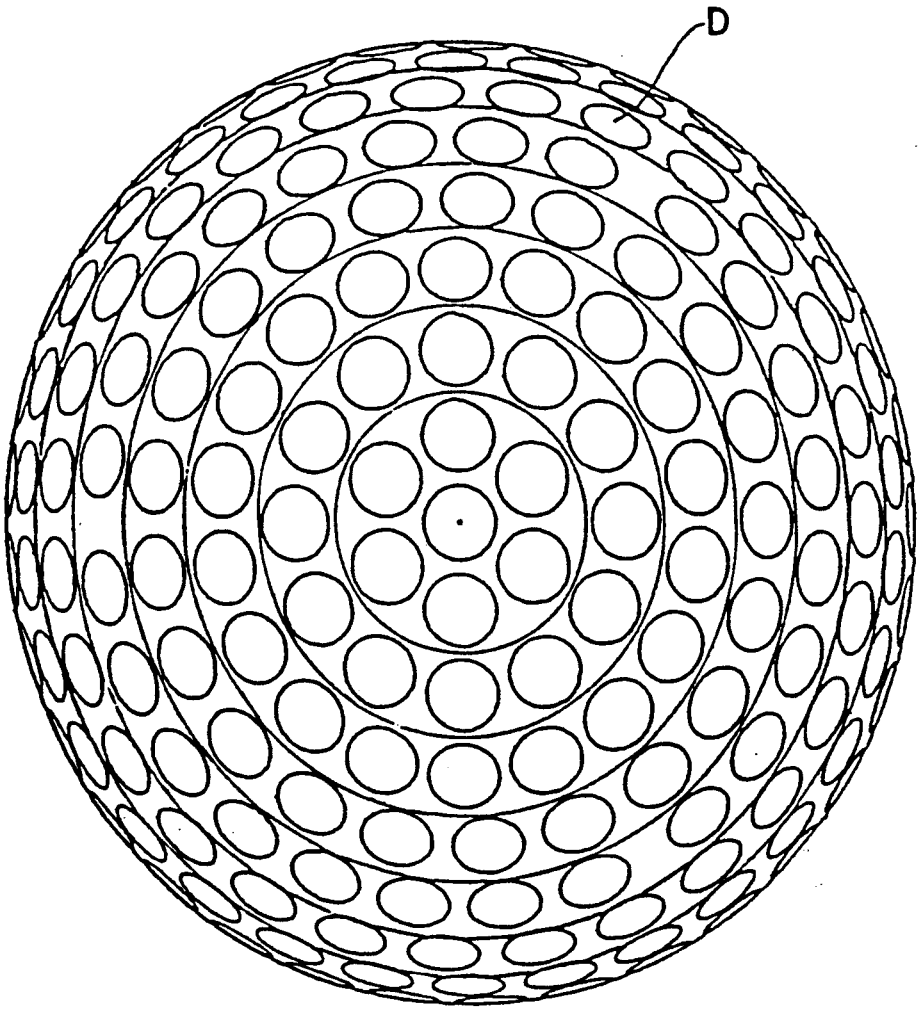
FIG. 8(II) is a view similar to FIG. 8(I), which particularly shows the golf ball as divided into a concentric arrangement.

The golf ball of comparative example 4 is of the concentric arrangement as shown in FIGS. 8(I) and 8(II), with the total number of dimples of 344 pieces.

Figure 9I:
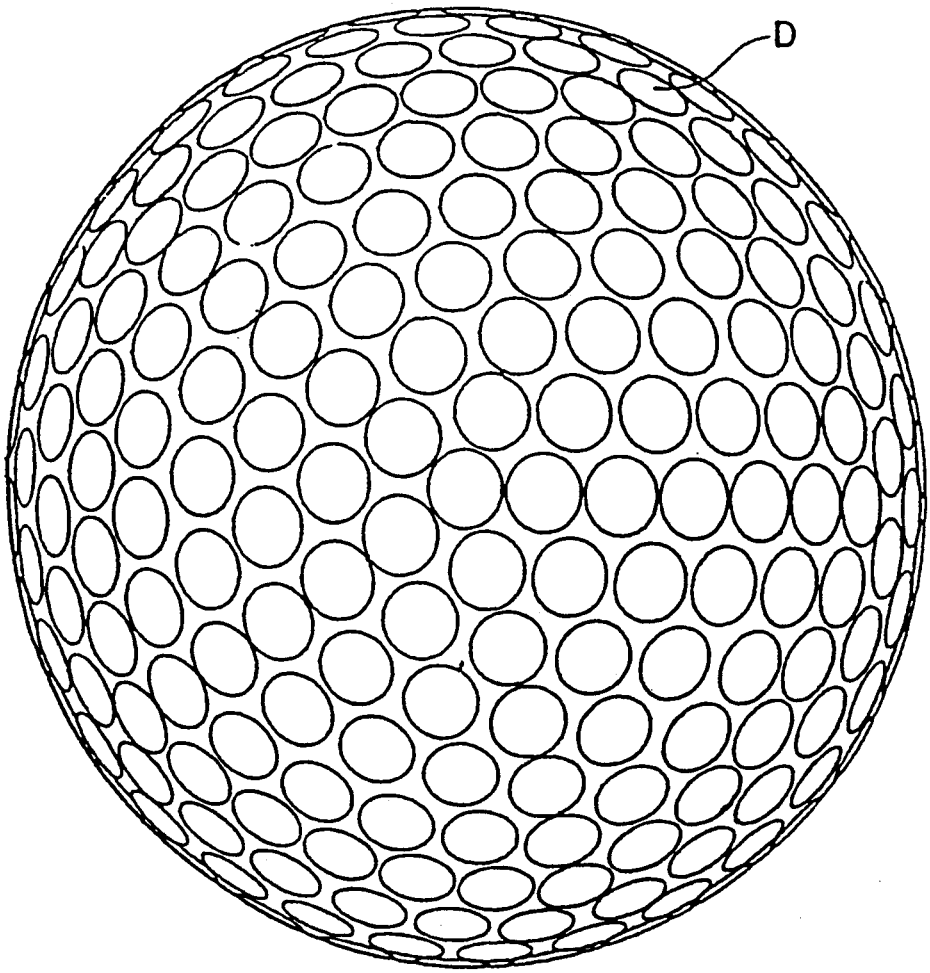
FIG. 9(I) is a front elevational view of a golf ball according to a fifth comparative example.
Figure 9:
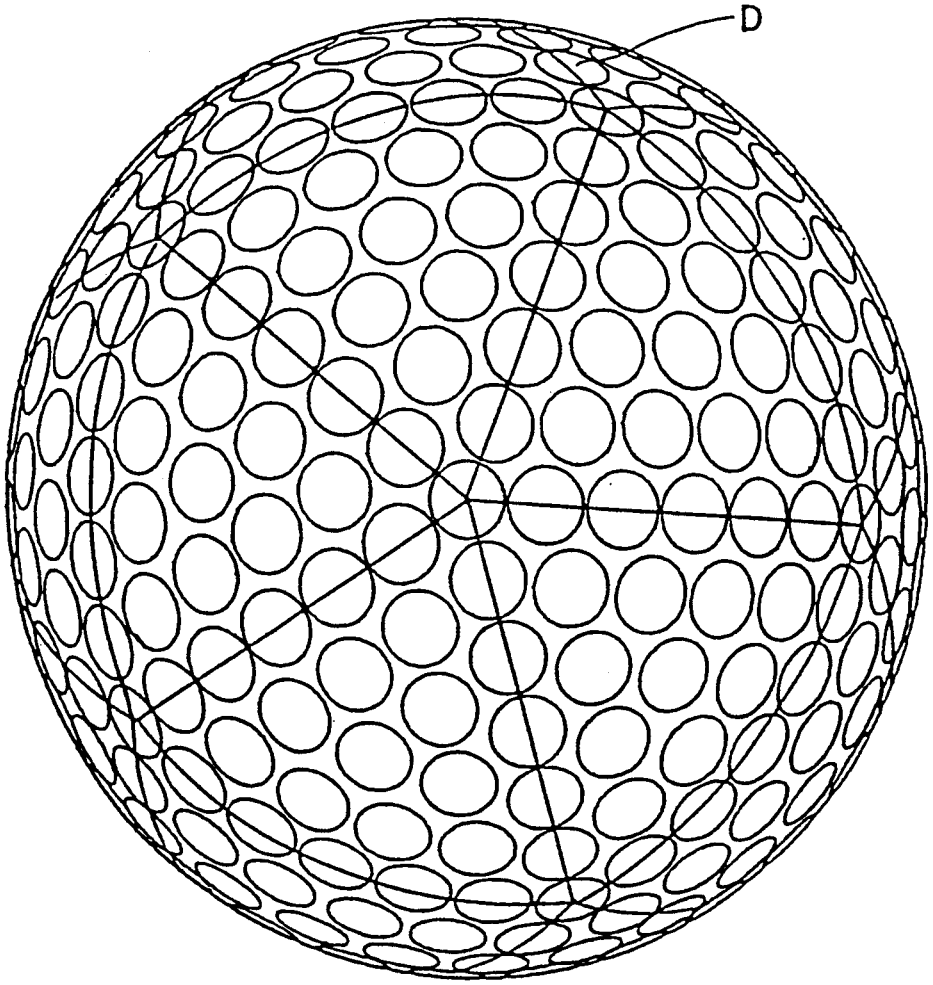
FIG. 9(II) is a view similar to FIG. 9(I), which particularly shows the golf ball as divided into a regular icosahedron pattern.

The golf ball of comparative example 5 is of the regular icosahedron arrangement as shown in FIGS. 9(I) and 9(II), with the total number of dimples of 392 pieces.

Each of the golf balls in the above embodiments 1, 2, 3 and 4, and the comparative examples 1 to 5 is of the "two-piece" golf ball having the same compositions and internal constructions. The specifications for the dimples of the respective golf balls are shown in Table 4 below.

TABLE 4

Dimple Specifications of Golf Balls in the Embodiments and Comparative Examples

| | Diameter (mm) | No. of pieces | Depth (mm) | Volume ($mm^3$) | Total Volume ($mm^3$) |
|---|---|---|---|---|---|
| Embod. 1 | 3.90 | 144 | 0.17 | 1.02 | 323 |
| | 3.65 | 198 | 0.17 | 0.89 | |
| Embod. 2 | 3.85 | 96 | 0.15 | 0.90 | 320 |
| | 3.65 | 120 | 0.15 | 0.81 | |
| | 3.40 | 198 | 0.15 | 0.69 | |
| Embod. 3 | 4.00 | 144 | 0.13 | 0.95 | 322 |
| | 3.60 | 72 | 0.13 | 0.79 | |
| | 3.20 | 144 | 0.13 | 0.64 | |
| | 2.80 | 72 | 0.13 | 0.50 | |
| Embod. 4 | 3.80 | 144 | 0.13 | 0.87 | 320 |
| | 3.30 | 168 | 0.13 | 0.67 | |
| | 2.90 | 96 | 0.13 | 0.53 | |
| | 2.60 | 72 | 0.13 | 0.43 | |
| Compar. 1 | 3.75 | 180 | 0.18 | 0.97 | 322 |
| | 3.55 | 120 | 0.18 | 0.87 | |
| | 3.20 | 60 | 0.18 | 0.71 | |
| Compar. 2 | 3.60 | 336 | 0.19 | 0.97 | 326 |
| Compar. 3 | 3.45 | 432 | 0.16 | 0.74 | 320 |
| Compar. 4 | 3.40 | 344 | 0.21 | 0.94 | 323 |
| Compar. 5 | 3.60 | 392 | 0.16 | 0.82 | 321 |

Carry Test

The golf balls of the above embodiments 1, 2, 3 and 4, and comparative examples 1 and 2 were subjected to the carry test under the conditions as follows.

For hitting the ball, Swing robot manufactured by True Temper Co. was used.

Club used: No. 1 driver

Head speed: 45 m/sec

No. of hits: eight times

Wind: 1 to 4 m/s (following wind)

Condition of lawn at landing location: good

Table 5 below shows results of the carry test, with each value showing an average of 20 balls. In Table 5, trajectory height means an angle of elevation from a launching point when the golf ball has reached the highest point.

TABLE 5

| | High trajectory test | | | Low trajectory test | | |
|---|---|---|---|---|---|---|
| | Carry (m) | Total (m) | Traject. height | Carry (m) | Total (m) | Traject. height |
| Embod. 1 | 206.9 | 215.2 | 13.93° | 208.7 | 230.8 | 12.56° |
| Embod. 2 | 212.8 | 223.2 | 13.42° | 205.4 | 227.9 | 12.33° |
| Embod. 3 | 210.7 | 221.7 | 13.27° | 204.2 | 227.0 | 12.11° |
| Embod. 3 | 209.0 | 220.1 | 13.01° | 203.3 | 226.8 | 11.89° |
| Compar. 1 | 208.0 | 217.0 | 13.60° | 205.9 | 228.5 | 12.48° |
| Compar. 2 | 205.4 | 213.1 | 14.11° | 205.9 | 225.0 | 12.73° |
| Compar. 3 | 208.3 | 218.9 | 13.21° | 203.6 | 224.5 | 12.05° |

The average trajectory height by a golf player with the head speed of 45 m/s is about 13.0° when the golf ball of comparative example 1 is used, and the test at the trajectory height of 13.60° effected this time (by the golf ball of comparative example 1) is in somewhat high trajectory conditions, while the test at the trajectory height of 12.48° (by the golf ball of comparative example 1) may be regarded as in rather low trajectory conditions.

From the above test results, it is seen that, in any of the high trajectory test and the low trajectory test, the golf ball with a larger number of dimples has lower trajectory height, while the golf ball with a smaller number of dimples has higher trajectory height.

In the high trajectory test, the golf ball which flew best was that having the dimple number of 414 pieces in embodiment 2. In the high trajectory test, the golf ball with a smaller number of dimples was disadvantageous in terms of carry since it rises too high, and particularly, less in the run, thus reducing the total carry. Accordingly, the golf ball of embodiment 2 with a large number of dimples and difficult to rise becomes advantageous. However, in the case where the dimple number is excessively large, the tendency is such that the golf ball is too low to achieve a sufficient carry, resulting in the reduction of the total carry as that in the golf ball of comparative example 3. In other words, under the conditions as described above, the number of dimples in the vicinity of about 414 pieces may be regarded as optimum.

Meanwhile, in the low trajectory test, the golf ball which flew best was that having the dimple number of 342 pieces in embodiment 1. In the low trajectory test, the golf ball with a larger number of dimples was disadvantageous in that it does not rise high, and particularly, less in the carry. Accordingly, the golf ball of embodiment 1 with a smaller number of dimples and easy to rise becomes advantageous. However, in the case where the dimple number is excessively small, the tendency is such that the golf ball rises too high to achieve a sufficient run, also resulting in the reduction of the total carry as in the golf ball of comparative example 2, with the dimple number of 336 pieces. In other words, under the conditions as described above, the number of dimples in the vicinity of about 342 pieces may be regarded as optimum.

It is not possible to design the golf ball having the optimum number of dimples under the two conditions for the tests as described above by the conventional regular dodecahedron arrangement, icosahedron-dodecahedron arrangement, and regular octahedron arrangement, and such golf ball can only be realized by the cubic octahedron arrangement with a high freedom for designing according to the present invention.

Symmetrical Characteristic Test

The golf balls of embodiments 1, 2, 3 and 4 and comparative examples 4 and 5 were subjected to the carry test following the symmetrical characteristic test as set forth by the USGA through employment of Swing robot manufactured by True Temper Co. under the conditions as follows.

Club used: No. 1 driver

Head speed: 48.8 m/sec

No. of hits: "pole" hitting—20 times; "seam" hitting—20 times

Wind: 0 to 3 m/s (following wind)

Condition of lawn at landing location: good

Table 6 below shows results of the carry test, with each value showing an average of 20 balls. In Table 6, under respective headings of carry, total and trajectory height, figures for the upper columns are related to "pole" hitting, while those for the lower columns are related to "seam" hitting.

It is to be noted here that "seam" hitting as referred to above means a way of hitting in which "back spin" is applied to the golf ball by setting, as a rotary axis, a line connecting both poles when a parting line of a split mold is regarded as an equator of a terrestrial globe, while "pole" hitting is a way of hitting in which "back spin" is applied by setting, as a rotary axis, a line intersecting at right angles with the above rotary axis.

TABLE 6

| | Carry (m) | Total (m) | Traject. height |
|---|---|---|---|
| Embod. 1 | 238.4 | 253.9 | 13.41° |
| | 238.1 | 254.2 | 13.38° |
| Embod. 2 | 237.1 | 254.0 | 12.87° |
| | 236.5 | 253.2 | 12.81° |
| Embod. 3 | 236.0 | 253.4 | 12.61° |
| | 236.0 | 253.0 | 12.63° |
| Embod. 4 | 236.2 | 253.9 | 12.25° |
| | 235.9 | 252.9 | 12.25° |
| Compar. 4 | 237.7 | 252.7 | 13.46° |
| | 231.2 | 247.5 | 13.02° |
| Compar. 5 | 236.5 | 252.5 | 13.12° |
| | 228.9 | 245.9 | 12.66° |

As is clear from the above Table 6, the golf ball of the cubic octahedron arrangement of embodiments 1, 2, 3 and 4 has almost no difference in the carry and trajectory height between the "pole" hitting and "seam" hitting. On the contrary, in the golf ball in the concentric arrangement of comparative example 4 and that in the regular icosahedron arrangement of comparative example 5, the trajectory height for the "seam" hitting is lower than that for the "pole" hitting, thus not providing a sufficient carry. In other words, these golf balls of comparative examples 4 and 5 may be said to be golf balls poor in the symmetrical characteristic.

It should be noted here that the present invention is based on the assumption that the dimples are uniformly arranged over the entire surface of the golf ball. In the case where the arrangement of the dimples is non-uniform, for example, even if one dimple is further added to only one of the twelve spherical regular triangles for the golf ball with 360 dimples of comparative example 1 so as to make the number of dimples to 361 pieces, such an addition will give no useful effect to the aerodynamic characteristics on the entire surface of the golf ball, and cannot be considered as an improvement on the freedom for designing. According to the present invention, the non-uniform arrangement of 361 dimples as referred to above is regarded to be in the category of the uniform arrangement of 360 dimples.

As is clear from the foregoing description, in the golf ball according to the present invention, since the dimples to be formed on the surface of the golf ball are arranged in the cubic octahedron pattern, the spherical surface symmetrical characteristic of the dimples is favorable to meet the requirement for non-directivity, and it is possible to design golf balls having various total number of dimples within the range of dimple total numbers of 300 to 600 pieces. Therefore, golf balls with proper number of dimples may be prepared according to skill, physical strength or age, etc. of the golf players, thereby to cope with the diversifying market requirements.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. The method of making a family of golf balls, each ball having substantially identical carry characteristics in both the pole and seam hitting modes and having between 300 and 600 dimples arranged on the spherical surfaces thereof, comprising the steps of:

projecting a cubic octahedron on the spherical surface of a said golf ball to provide four great circle paths thereon defining six spherical squares and eight spherical triangles on the said surface;

placing a plurality of dimples in said surface within said squares and triangles without intersecting said dimples and said great circle paths; and selecting the number of dimples in each said square and triangle such that the total number of dimples on a said ball is a natural number satisfying one of the following formulae:

$$(4m\times 6)+(3n\times 8)$$

$$((4m+1)\times 6)+(3n\times 8)$$

$$(4m\times 6)+((3n+1)\times 8)$$

$$((4m+1)\times 6)+((3n+1)\times 8)$$

where m is a natural number representative of the number of dimples within one spherical square and n is a natural number representative of the number of dimples within one spherical triangle.

2. The method of claim 1, including the further step of imparting a total volume to the dimples in a said ball of between 250 to 400 $mm^3$.

3. The method of claim 1, including the step of arranging the dimples on a said ball in point or line symmetry within said spherical squares and spherical triangles.

4. The method of claim 1, including the further step of imparting a total volume to the dimples in a said ball of between 280 to 350 $mm^3$.

5. The method of claim 1, including the further step of imparting a total volume to the dimples in a said ball of between 250 to 400 $mm^3$; and including the step of arranging the dimples on a said ball in point or line symmetry within said spherical squares and spherical triangles.

6. The method of claim 1, including the step of arranging the dimples on a said ball in point or line symmetry within said spherical squares and spherical triangles; and including the further step of imparting a total volume to the dimples in a said ball of between 280 to 350 $mm^3$.

7. The method of claim 1, including the step of arranging the dimples in each of said squares symmetrically about the diagonals of said squares.

8. The method of claim 1, including the step of arranging the dimples in each of said spherical triangles in three symmetrically disposed identical triangular patterns.

9. The method of claim 1, including the step of arranging the dimples in each of said squares symmetrically about the diagonals of said squares; and including the step of arranging the dimples in each of said spherical triangles in three symmetrically disposed identical triangular patterns.

10. The method of claim 1, including the step of arranging the dimples in each of said spherical squares in four identical triangular patterns.

11. The method of claim 1, including the step of arranging the dimples in each of said spherical triangles in three symmetrically disposed identical triangular patterns; and including the step of arranging the dimples in each of said spherical squares in four identical triangular patterns.

12. The method of claim 1, including the step of arranging some of the dimples in each spherical square in a smaller spherical square pattern therein.

13. The method of claim 1, including the step of arranging the dimples in each of said spherical triangles in three symmetrically disposed identical triangular patterns; and including the step of arranging some of the dimples in each spherical square in a smaller spherical square pattern therein.

14. The method of claim 1, including the step of arranging some of the dimples in each spherical square in a smaller spherical square pattern and all of the dimples in each spherical square symmetrically about the diagonals of each spherical square.

15. The method of claim 1, including the step of arranging the dimples in each of said spherical triangles in three symmetrically disposed identical triangular patterns; and including the step of arranging some of the dimples in each spherical square in a small spherical square pattern and all of the dimples in each spherical square symmetrically about the diagonals of each spherical square.

16. The method of making a family of golf balls, each ball having substantially identical carry characteristics in both the pole and seam hitting modes and a number of dimples arranged on the spherical surface thereof ranging from 312 to 500 in increments of 24 dimples, comprising the steps of:

projecting a cubic octahedron on the spherical surface of a said golf ball to provide four great circle paths thereon defining six spherical squares and eight spherical triangles on the said surface;

placing a plurality of dimples in said surface within said squares and triangles without intersecting said dimples and said great circle paths; and selecting the number of dimples in each said square and triangle such that the total number of dimples on a said ball is a natural number satisfying the following formula:

$$(4m \times 6) + (3n \times 8)$$

where m is a natural number representative of the number of dimples within one spherical square and n is a natural number representative of the number of dimples within one spherical triangle.

17. The method of making a family of golf balls, each ball having substantially identical carry characteristics in both the pole and seam hitting modes and a number of dimples arranged on the spherical surface thereof ranging from 318 to 582 in increments of 24 dimples, comprising the steps of:

projecting a cubic octahedron on the spherical surface of a said golf ball to provide four great circle paths thereon defining six spherical squares and eight spherical triangles on the said surface;

placing a plurality of dimples in said surface within said squares and triangles without intersecting said dimples and said great circle paths; and selecting the number of dimples in each said square and triangle such that the total number of dimples on a said ball is a natural number satisfying the following formula:

$$((4m+1) \times 6) + (3n \times 8)$$

where m is a natural number representative of the number of dimples within one spherical square and n is a natural number representative of the number of dimples within one spherical triangle.

18. The method of making a family of golf balls, each ball having substantially identical carry characteristics in both the pole and seam hitting modes and a number of dimples arranged on the spherical surface thereof ranging from 320 to 584 in increments of 24 dimples, comprising the steps of:

projecting a cubic octahedron on the spherical surface of a said golf ball to provide four great circle paths thereon defining six spherical squares and eight spherical triangles on the said surface;

placing a plurality of dimples in said surface within said squares and triangles without intersecting said dimples and said great circle paths; and selecting the number of dimples in each said square and triangle such that the total number of dimples on a said bal is a natural number satisfying the following formula:

$$(4m \times 6) + ((3n+1) \times 8)$$

where m is a natural representative of the number of dimples within one spherical square and n is a natural number representative of the number of dimples within one spherical triangle.

19. The method of making a family of golf balls, each ball having substantially identical carry characteristics in both the pole and seam hitting modes and a number of dimples arranged on the spherical surface thereof ranging from 302 to 590 in increments of 24 dimples, comprising the steps of:

projecting a cubic octahedron on the spherical surface of a said golf ball to provide four great circle paths thereon defining six spherical squares and eight spherical triangles on the said surface;

placing a plurality of dimples in said surface within said squares and triangles without intersecting said dimples and said great circle paths; and selecting the number of dimples in each said square and triangle such that the total number of dimples on a said ball is a natural number satisfying the following formula:

$$((4m+1) \times 6) + ((3n+1) \times 8)$$

where m is a natural number representative of the number of dimples within one spherical square and n is a natural number representative of the number of dimples within one spherical triangle.

* * * * *

UNITED STATES PATENT AND TRADEMARK OFFICE

CERTIFICATE OF CORRECTION

PATENT NO. : 5,092,604

DATED : March 3, 1992

INVENTOR(S) : Kengo OKA

It is certified that error appears in the above-identified patent and that said Letters Patent is hereby corrected as shown below:

On the title page, Item [63]: please change "307,757" to read --306,757--.

Signed and Sealed this

Twenty-first Day of September, 1993

Bruce Lehman

*Attest:*

BRUCE LEHMAN

*Attesting Officer*

*Commissioner of Patents and Trademarks*